United States Patent [19]

Matsuo

[11] 4,069,537

[45] Jan. 24, 1978

[54] MOP MEANS

[76] Inventor: Setsuko Matsuo, 954-4, Aza Uoya, Miyaza, Japan

[21] Appl. No.: 784,745

[22] Filed: Apr. 5, 1977

Related U.S. Application Data

[63] Continuation-in-part of Ser. No. 597,184, July 18, 1975, abandoned.

[30] Foreign Application Priority Data

Dec. 28, 1974 Japan ..... 50-2640

[51] Int. Cl.[2] ..... A47L 13/256

[52] U.S. Cl. ..... 15/228; 15/160; 15/247

[58] Field of Search ..... 15/106, 114, 115, 116, 15/117, 147 R, 147 A, 159 R, 160, 228, 247

[56] References Cited

U.S. PATENT DOCUMENTS

| | | | |
|---|---|---|---|
| 2,540,768 | 2/1951 | Vaughn | 15/244 R |
| 3,295,155 | 1/1967 | Belsky et al. | 15/228 X |

FOREIGN PATENT DOCUMENTS

| | | | |
|---|---|---|---|
| 755,523 | 9/1933 | France | 15/114 |
| 2,231,188 | 12/1974 | France | 15/247 |
| 867,237 | 2/1953 | Germany | 15/106 |
| 38,116 | 10/1923 | Norway | 15/114 |

*Primary Examiner*—Daniel Blum
*Attorney, Agent, or Firm*—Karl W. Flocks

[57] ABSTRACT

A mop having a parallelepiped body of which the front and the rear surfaces extend downwardly and forwardly, and a rod handle fixed to the top of the parallelepiped body. The rod handle is so arranged that the rod handle extends in a plane parallel with the front surface of the parallelepiped body. In the under surface of the parallelepiped body, there are attached a plurality of elastic strands under and by which is held a wiping cloth.

2 Claims, 5 Drawing Figures

MOP MEANS

CROSS-REFERENCE TO THE RELATED APPLICATION

This is a continuation-in-part of U.S. Ser. No. 597,184 filed on July 18, 1975, now abandoned.

BACKGROUND OF THE INVENTION

The present invention relates to a mop for cleaning a floor, a ceiling and a wall in a room or a passage, and particularly, relates to a mop suitable for cleaning corners of a room or a narrow space under a desk or the like.

There has been used a mop setting a wiping cloth or a sponge like material at its end so as to clean or polish a floor. However, such a kind of mop is not suitable for cleaning the corners of a room or narrow spaces under a desk or a table.

Further, previous mops have been such that a wiping cloth is set at its forward end, periodically replaced with a clean one. To set or replace the wiping cloth is laborious.

The present invention is to eliminate the abovesaid disadvantages. The present invention is to provide a mop suitable for cleaning anywhere even a corner area or a narrow space.

A mop according to the present invention is the one which easily holds a wiping cloth at the forward end thereof. Therefore, the replacement of such a wiping cloth is not laborious.

The present invention will be described in more detail by preferred embodiment together with the accompanying drawings.

BRIEF DESCRIPTION OF THE DRAWING

Understanding of the invention will be facilitated by referring to the accompanying drawing, in which like numbers refer to like parts in the several views and in which.

DESCRIPTION OF THE PREFERRED EMBODIMENT

Figure 1:
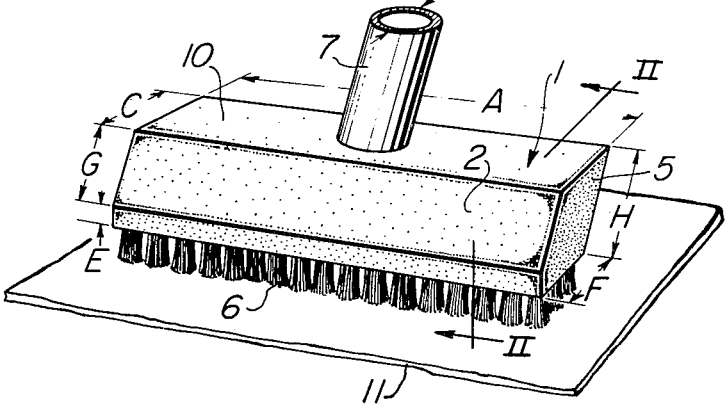
FIG. 1 is a perspective view of a mop embodying the principles of the invention.

In the drawings, reference numeral 1 designates a solid parallelepiped body. The parallelpiped body 1 has a front and a rear surfaces 2 and 3 extending downwardly and forwardly; left and right lateral surfaces 4 and 5; a top surface 10; and an under surface 9 in which a plurality of elastic bristle strands 6 are attached. In the top surface 10, a rod handle 7 is fixed at the center portion of the top surface 10. The rod handle 10 is so arranged that the central longitudinal axis thereof extends in a plane parallel with the front surface 2 of the parallelepiped body 1. The front, left and right lateral, and top surfaces 2, 5, 4 and 10 of the parallelepiped body 1 are all covered with a cushion layer 8 which is to avoid marring furniture and the like during use of the mop.

The elastic bristle strands 6 provided in the under surface of the parallelepiped body 1 are to hold a wiping cloth 11 which is spread on a surface to be cleaned. Thus, the wiping cloth 11 is easily held at the forward end of the mop by forcing the mop downwardly against the wiping cloth 11, thereby enabling the wiping cloth to wipe a surface to be cleaned, when the mop is moved along the surface. Felt or nylon strands may be used for the above elastic bristle strands 6.

Figure 2:
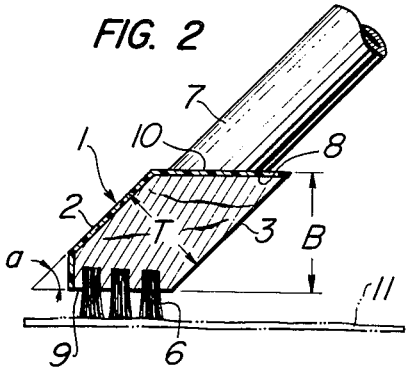
FIG. 2 is a cross-sectional view of the mop taken along the line II — II in FIG. 1.
Figure 3:
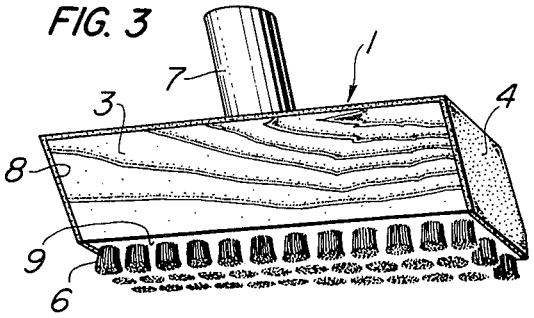
FIG. 3 is another perspective view which shows the underside of the mop holder.

The mop in this embodiment preferably has the following dimensions: referring to FIG. 1 and FIG. 2;

A : 17 cm
B : nearly 4 cm
C : 4.5 cm
D : 2.5 cm
E : 1 cm
F : 3.5 cm
G : 4.0 cm
H : 4.5 cm
T : nearly 3.2 cm (thickness)
angle *a* : apploximately 45°.

Figure 5:
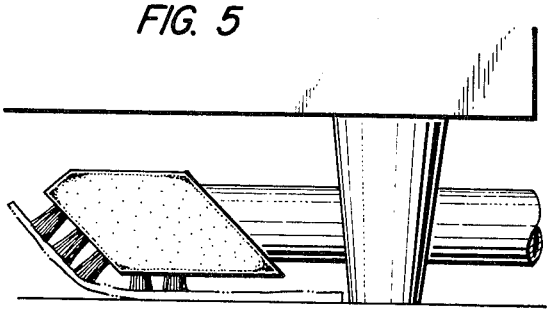
FIG. 5 is a view illustrating the cleaning operation of the mop of FIG. 4 according to the present invention.

It should be noted that the thickness T of the parallelepiped body 1 is slightly larger than the diameter D of the rod handle 7. Therefore, the mop with a wiping cloth 11 is effectively used to clean a surafce under a desk or the like which has a narrow space defined against its floor surface, by tilting the rod handle 7 substantially parallel with the floor as shown in FIG. 5.

Figure 4:
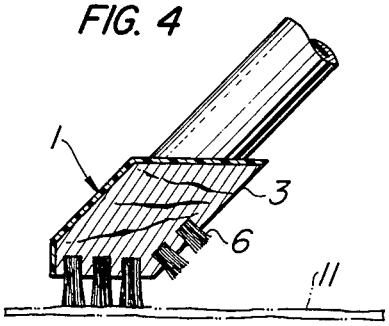
FIG. 4 is a cross-sectional view of another embodiment of a mop similar to FIG. 2.

To effectively wipe such a surface under the desk, the bristle strands 6 may be attached in the rear surafce 3 of the parallelepiped body 1 as shown in FIG. 4, thereby to positively hold a wiping cloth 11 when the mop is tilted substantially parallel with the floor.

When the mop having the preferable dimensions as mentioned above, is used, it may be possible to clean a surface under a desk having a narrow space defined against the surface, even if the narrow space under the desk has a height of about 5 cm.

Further, thanks to the advantageous shape of the parallelepiped body 1 which has the front and rear surfaces extending downwardly and forwardly, it is possible to clean in every nook and corner of a room.

Thus, the present present invention provides a mop which is of simple structure having high-durability.

What we claim is:

1. A mop comprising:

a parallelepiped body made of a rigid material, said parallelepiped body having a front and a rear surfaces extending downwardly and forwardly;

a plurality of downwardly extending elastic gripping bristles attached to the under surface of the parallelepiped body;

an elongated rod handle secured substantially in the center of the top surface of said parallelepiped body, the central longitudinal axis of which extends in a plane substantially parallel with the front surface of the parallelepiped body; said rod handle having a diameter slightly smaller than the thickness of the parallelepiped body;

a cushion member covering the front, right and left lateral, and top surfaces of the parallelepiped body; and replaceable wiping means releasably gripped on the bottom surface of the parallelepiped body by pressing said downwardly extending bristles, whereby the mop may be used with tilting of the handle parallel to the floor.

2. A mop as set forth in claim 1, in which gripping bristles are also attached to said rear surface of the parallelepiped body.

* * * * *